United States Patent [19]

Lee et al.

[11] Patent Number: 4,893,987

[45] Date of Patent: Jan. 16, 1990

[54] DIFFUSION-COOLED BLADE TIP CAP

[75] Inventors: Ching P. Lee; Eugene T. Vaughn, both of Cincinnati; Nicholas C. Palmer, Loveland, all of Ohio

[73] Assignee: General Electric Company, Cincinnati, Ohio

[21] Appl. No.: 130,597

[22] Filed: Dec. 8, 1987

[51] Int. Cl.[4] ..... F01D 5/18

[52] U.S. Cl. ..... 416/92; 416/97 R

[58] Field of Search ..... 416/92, 97 R, 96 R, 416/228; 415/172 A, 115, 174

[56] References Cited

U.S. PATENT DOCUMENTS

| | | | |
|---|---|---|---|
| 3,014,270 | 12/1961 | Eccles | 416/92 |
| 3,527,543 | 9/1970 | Howald | 416/92 |
| 3,635,585 | 1/1972 | Metzler, Jr. | 416/96 |
| 3,706,508 | 12/1972 | Moskowitz et al. | 416/92 X |
| 3,899,267 | 8/1975 | Dennis et al. | 416/92 |
| 4,247,254 | 1/1981 | Zelahy | 416/97 R |
| 4,321,010 | 3/1982 | Wilkinson et al. | 416/92 |
| 4,390,320 | 1/1983 | Eiswerth | 416/97 R |
| 4,411,597 | 10/1983 | Koffel et al. | 416/92 |
| 4,424,001 | 1/1984 | North et al. | 416/92 |
| 4,540,339 | 9/1985 | Horvath | 416/92 |
| 4,606,701 | 8/1986 | McClay et al. | 416/92 |
| 4,653,983 | 3/1987 | Vehr | 416/97 R |
| 4,726,104 | 2/1988 | Foster et al. | 416/97 R X |
| 4,761,116 | 8/1988 | Braddy et al. | 416/92 |

FOREIGN PATENT DOCUMENTS

| | | | |
|---|---|---|---|
| 207799 | 1/1987 | European Pat. Off. | 416/92 |
| 225231 | 4/1943 | Switzerland | 416/92 |
| 656634 | 8/1951 | United Kingdom | 416/92 |
| 1285369 | 8/1972 | United Kingdom | 416/92 |

*Primary Examiner*—Everette A. Powell, Jr.

*Attorney, Agent, or Firm*—Steven J. Rosen; Jerome C. Squillaro

[57] ABSTRACT

An improved turbine blade tip with diffusion cooling holes in the tip is disclosed. One particular embodiment of the invention provides an improved squealer blade tip with diffusion cooling holes in the tip. Yet another embodiment of the invention provides blade tip diffusion cooling holes comprising a first cylindrical portion coupled to a second conical portion.

36 Claims, 1 Drawing Sheet

DIFFUSION-COOLED BLADE TIP CAP

FIELD OF THE INVENTION

This invention relates generally to gas turbine engine blades and, more particularly, to an improved squealer tip-type blade with diffusion cooling holes in the blade tip.

BACKGROUND OF THE INVENTION

This invention relates to gas turbine engine blades and, more particularly, to an improved tip cap configuration for a cooled turbine blade. It is well known that gas turbine engine efficiency is, at least in part, dependent upon the extent to which hot expanding combustion gases in the turbine leak across a gap between turbine blades and seals or shrouds which surround them. The problem of sealing between such cooperating members is very difficult in the turbine section because of high temperatures and centrifugal loads. One method of improving the sealing between the turbine blade and seal or shroud is the use of squealer tips such as those shown in U.S. Pat. Nos. 4,540,339 and 4,247,254, the disclosures of which are herein incorporated by reference. Other tip arrangements have been used including flat blade tip surfaces facing the shroud. Blade tips because they are often abrasively worn down during engine operation have been made removable in order to prolong the life of the remaining portion of the blade. Cooling of the turbine blades is required in modern gas turbine engines because of the very high temperatures involved. Therefore, various types of hollow blades or blades with air passages contained within have been designed to cool the walls of the turbine blade.

A variety of configurations for tip caps for the type of hollow turbine blades used in modern gas turbine engines have been developed. During operation of a gas turbine engine, interference between such relatively rotating blade tips and surrounding shrouds or seals causes heating of the blade tip resulting in excessive wear or damage to the blade tips and shrouds or seals. Temperature changes create differential rates of thermal expansion and contraction on the rotor and shroud which may result in rubbing between the blade tips and shrouds. Centrifugal forces acting on the blades and structural forces acting on the shroud create distortions thereon which may also result in rubs. It is, therefore, desirable to cool the blade tips. In the case of squealer type tips augmented heating occurs in the cavity between the walls of the squealer tip which requires additional cooling. Because of the complexity and relative high cost of replacing or repairing the blades, it is desirable to prolong the life of the blade tips and respective blades as long as possible. Blade tip cooling holes are known in the art as shown in U.S. Pat. No. 4,247,254 and as applied to squealer tips in U.S. Pat. No. 4,540,339. Turbine blade designers and engineers are constantly striving for more efficient means of cooling the turbine blade tips. Cooling air used to accomplish this is expensive in terms of overall fuel consumption and therefore more efficient means of cooling improves the efficiency of the engine thereby lowering the engine's operating cost. Turbine blade designers and engineers are also striving to design more effective means of cooling the turbine blade tips in order to prolong turbine blade life and thereby again reducing the engine's operating cost.

OBJECTS OF THE INVENTION

It is an object of the present invention to provide a new and improved rotor blade tip.

It is another object of the present invention to provide a rotor blade tip with improved cooling holes.

It is another object of the present invention to provide a rotor blade tip of the squealer-type with improved cooling holes.

It is a further object of the present invention to provide an improved rotor blade tip configured to improve cooling and prolong the life thereof.

It is yet another object of the present invention to provide an improved rotor blade tip which is relatively easy to manufacture.

SUMMARY OF THE INVENTION

In the present invention, a hollow rotor blade includes an improved blade tip with endwall diffusion cooling holes. According to one form of the present invention the diffusion cooling holes comprise a cylindrical metering section and a conical diffusion section. According to another form of the present invention the blade tip is of the squealer type.

DETAILED DESCRIPTION OF THE INVENTION

Figure 1:
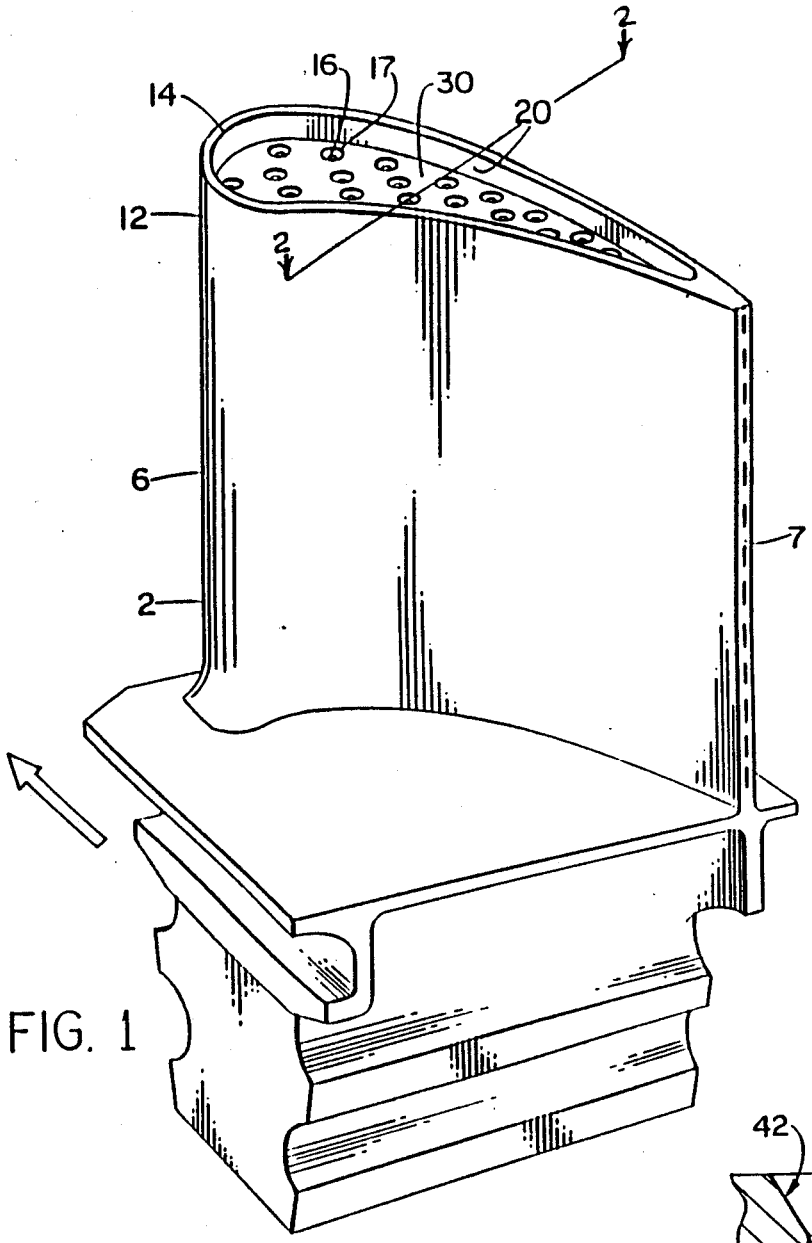
FIG. 1 is a perspective view of a cooled turbine rotor blade including a tip of the squealer type according to one form of the present invention.

FIG. 1 shows a hollow rotor blade 2 according to one form of the present invention which is rotatable about the engine centerline (not shown) in the direction of the arrow. Blade 2 includes a leading edge 6, a trailing edge 7 and, at the radially outer end of blade 2, a squealer-type blade tip 12. Blade tip 12 comprises a radially extending squealer tip wall 14 disposed about the radially outward perimeter of the blade tip 12. Diffusion cooling holes 16 including an outlet 17 are used to cool endwall 30 and cavity 20 formed by tip wall 14.

Figure 2:
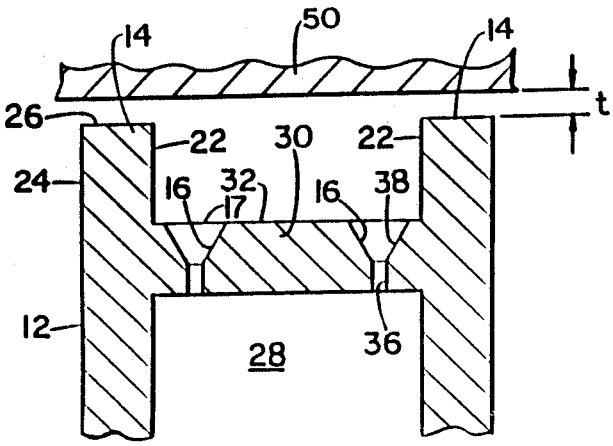
FIG. 2 is a cross-sectional view taken along the line 2—2 in FIG. 1 and shows the cross section of the blade tip.

FIG. 2 is a fragmentary, cross-sectional view of a squealer-type blade tip 12 shown in FIG. 1. Blade tip 12 includes a squealer tip wall 14 which includes an inner surface 22 and an outer surface 24 and a top surface 26. The blade tip 12 includes an endwall 30 which radially caps a cooling air plenum 28 in the hollow section of blade 2 and has a generally flat endwall outer surface 32. In general a blade tip endwall 30 is used to radially cap the hollow section of a cooled blade wherein the hollow section may be a plenum or complicated cooling air path. As can be seen from FIG. 1 and FIG. 2, squealer tip wall 14 and endwall outer surface 32 comprise the heated surface of cavity 20. Shroud 50 circumscribes the path within which blade 2 rotates and seals the flow path by maintaining a very small clearance t with top surface 26 of tip wall 14.

Figure 3:
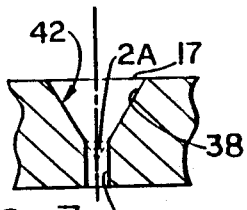
FIG. 3 is a diagrammatic view of a funnel shaped diffusion cooling hole.

FIG. 3 shows the preferred embodiment of the invention's funnel shaped diffusion cooling hole 16 having a radially inner cylindrical portion 36 and a radially outer conical section 38. The conical Section 38 is defined by its conical angle 2A, an important parameter which controls separation of the cooling flow. The conical section 38 also provides a cooling surface 42 which improves the cooling of the blade tip. In operation blade 2 is rotatable with respect to shroud 50, also referred to as a seal, in the direction of the arrow in FIG. 1.

A tip clearance "t" between the squealer tip wall 14 and the shroud 50 is an important operating parameter that should be minimized and controlled at all times. The region of the blade tip is subject to very high heating and especially in the area of the cavity 20. Due to the effect of viscous forces augmented heating will occur in the cavity further heating the blade endwall 30 and the squealer tip wall 14. In addition planned or unplanned rubbing between the squealer tip wall 14 and the shroud 50 produces heating due to friction of the squealer tip wall 14. Diffusion cooling holes 16 provide cooling air to the external heated regions of the blade tip to cool the squealer tip wall 14 and the blade's endwall 30.

Diffusion cooling holes, by definition, are designed to diffuse or lower the velocity of the cooling air passing through it. The efficiency of the diffusion cooling holes 16 is further enhanced by the funnel shape of the diffusion cooling holes. The metering section 36

, preferably cylindrical in shape or having a circular cross section,--.

meters the flow rate of the cooling air and helps control the minimum flow area and therefore maintain a well defined metering area--.

. The conical section 38 diffuses the cooling air and is designed with an angle that is sufficiently small to prevent separation of the cooling airflow at or near the intersection of the cylindrical section and conical section. We have found that an important relationship exists between the lengths of the metering section 36 and the diffusion section 38 and that the metering section should be shorter than the diffusion section in a preferred range of 30 to 63 percent. A wide opening 17 of conical section 38 prevents the deposition of shroud material in cooling hole 16, commonly referred to as smearing, from fully clogging up the cooling hole. Smearing occurs during rubs and the present invention minimizes the detrimental effects of severely clogged cooling holes. The shape of the conical section also provides endwall 30 with a greater cooling area thereby increasing the overall performance and longevity of the blade tip 12. In order to maximize the cooling effect on the endwall 30 the conical angle 2A in FIG. 3 should be as large as possible without causing separation of the internal cooling flow along the surface 42 of the conical section 38. We have found that a preferred range of 23-53 degrees for conical angle 2A exists which yields improved endwall cooling. Separation would reduce or eliminate the benefits provided by the diffusion process and the associated cooling of the sidewall 30 and cavity 20. Other diffusion cooling holes having different cross-sectional shapes may also be used. The funnel shape of the cooling hole in the preferred embodiment is an important feature of the present invention because it is easy to manufacture which is one objective of the present invention.

Figure 4:
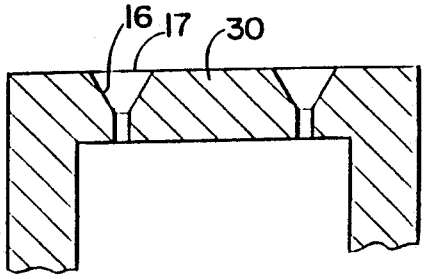
FIG. 4 is a cross-sectional view of a blade tip without a squealer tip according to an alternative form of the present invention.

An alternate form of the present invention is shown in FIG. 4. The radially directed blade tip cooling holes 16 are disposed in the endwall 30 of a blade tip without the squealer wall of FIG. 2. Blade tip diffusion cooling holes 16 are used to cool the tip of a nonsquealer-type blade tip where the diffusion cooling provides improved cooling of the blade tip thereby improving the engine's operation and blade tip life. The diffusion cooling holes provides more effective blade tip cooling than the prior art.

It will be clear to those skilled in the art that the present invention is not limited to the specific embodiments described and illustrated herein. Nor is the invention limited to turbine blades. Rather, the invention applies equally to any cooled blade.

It will be understood that the dimensions and proportional and structural relationships shown in these drawings are illustrated by way of example only and those illustrations are not to be taken as the actual dimensions or proportional structural relationships used in the blade tip of the present invention.

Numerous modifications, variations, and full and partial equivalents can be undertaken without departing from the invention as limited only by the spirit and scope of the appended claims.

What is claimed is:

1. A gas turbine engine cooled turbine blade tip comprising:

an endwall having at least one diffusion cooling hole for passing cooling flow therethrough.

2. The blade tip of claim 1 wherein said diffusion cooling hole including means to prevent separation of the cooling flow within said cooling hole.

3. The blade tip of claim 2 wherein said diffusion cooling hole comprises a radially inner metering section and a radially outer diffusing section.

4. The blade tip of claim 3 wherein said diffusion cooling hole is funnel shaped.

5. The blade tip of claim 4 wherein said diffusion cooling hole comprises a generally cylindrical metering section and a generally conical diffusion section.

6. The blade tip of claim 4 wherein the length of said metering section is smaller than the length of said diffusion portion.

7. The blade tip of claim 6 wherein ratio of said metering portion to said diffusion portion. is in the range of 32% to 62.5%.

8. The blade tip of claim 5 wherein said conical diffusion section has a cone angle in the range of 23 degrees to 53 degrees.

9. The blade tip of claim 3 wherein said diffusing portion includes a means to prevent separation of the cooling flow within said cooling hole.

10. A gas turbine engine coolable turbine blade squealer tip comprising:

an endwall including a radially inner cool side and a radially outer hot side having at least one diffusion cooling hole therethrough and a squealer tip wall extending radially outward from said hot side.

11. The squealer tip of claim 10 wherein said squealer tip wall circumscribes said endwall.

12. The squealer tip of claim 10 wherein said diffusion cooling hole comprises a radially inner metering portion and a radially outer diffusing section.

13. The squealer tip of claim 12 wherein said diffusing section includes a means to prevent separation of the cooling flow within said cooling hole.

14. The squealer tip of claim 12 wherein said diffusion cooling hole is funnel shaped.

15. The squealer tip of claim 12 wherein said diffusion cooling hole comprises a generally cylindrical metering section and a generally conical diffusing section.

16. The squealer tip of claim 15 wherein the length of said metering section is shorter than the length of said diffusing section.

17. The squealer tip of claim 16 wherein the length of said metering section is in the range of 32% to 62.5% of the length of said diffusing section.

18. The squealer tip of claim 16 wherein said conical diffusing section has a cone angle in the range of 23 degrees to 53 degrees.

19. A squealer type turbine blade comprising:

a cooling chamber radially outwardly capped by an endwall, said endwall including a radially inner cool side and a radially outer hot side having at least one diffusion cooling hole therethrough, and a squealer tip wall extending radially outward from said hot side.

20. The squealer type blade of claim 19 wherein said squealer tip wall circumscribes said endwall.

21. The squealer type blade of claim 19 wherein said diffusion cooling hole comprises a radially inner metering section and a radially outer diffusing section.

22. The squealer type blade of claim 21 wherein said diffusing section includes a means to prevent separation of the cooling flow within said cooling hole.

23. The squealer type blade of claim 21 wherein said diffusion cooling hole is funnel shaped.

24. The squealer type blade of claim 21 wherein said diffusion cooling hole comprises a generally cylindrical metering section and a generally conical diffusing section.

25. The squealer type blade of claim 24 wherein the length of said metering section is shorter than the length the said diffusing section.

26. The squealer type blade of claim 25 wherein the length of said metering section is in the range of 32% to 62.5% of the length of said diffusing section.

27. The squealer type blade of claim 25 wherein said conical diffusing section has a cone angle in the range of 23 degrees to 53 degrees.

28. A coolable turbine blade comprising:

a cooling chamber radially outwardly capped by an endwall, and said endwall includes at least one diffusion cooling hole therethrough.

29. The coolable turbine blade of claim 28 wherein said diffusion cooling hole comprises a radially inner metering section and a radially outer diffusing section.

30. The coolable turbine blade of claim 29 wherein said diffusing section includes a shape effective to prevent separation of the cooling flow within said cooling hole.

31. The collable turbine blade of claim 30 wherein said diffusion cooling hole is funnel shaped.

32. The coolable turbine blade of claim 29 wherein said diffusion cooling hole comprises a generally cylindrical metering section and a generally conical diffusing section.

33. The coolable turbine blade of claim 32 wherein the length of said metering section is shorter than the length of said diffusing section.

34. The coolable turbine blade of claim 33 wherein the length of said metering section is in the range of 32% to 62.5% of the length of said diffusing section.

35. The coolable turbine blade of claim 33 wherein said conical diffusing section has a cone angle in the range of 23 degrees to 53 degrees.

36. The blade tip of claim 2 wherein said means to prevent separation of the cooling flow within said cooling hole includes an inner surface of said hole having local surface angles sufficiently small to prevent separation of the cooling flow within said cooling hole.

* * * * *